US006490410B2

(12) United States Patent
Baribeault et al.

(10) Patent No.: US 6,490,410 B2
(45) Date of Patent: Dec. 3, 2002

(54) WALL MOUNTED ELECTRIC CONVECTION HEATER

(75) Inventors: Jean Baribeault, St-Mathieu-du-Parc (CA); Raynald Brassard, Shawinigan (CA); Éric Dumont, Trois-Rivières Ouest (CA); Robert D. Rendel, Laurinburg, NC (US); Raymond Lew, Laurinburg, NC (US)

(73) Assignee: Hydro-Quebec, Montreal (CA)

( * ) Notice: Subject to any disclaimer, the term of this patent is extended or adjusted under 35 U.S.C. 154(b) by 0 days.

(21) Appl. No.: 09/825,282

(22) Filed: Apr. 4, 2001

(65) Prior Publication Data

US 2002/0025144 A1 Feb. 28, 2002

(30) Foreign Application Priority Data

Apr. 4, 2000 (CA) ..... 2304406

(51) Int. Cl.[7] ..... F24D 13/00
(52) U.S. Cl. ..... 392/371
(58) Field of Search ..... 392/371, 370, 392/347, 352, 353

(56) References Cited

U.S. PATENT DOCUMENTS 1,518,067 A * 12/1924 Hicks ..... 392/371
1,651,890 A * 12/1927 Hicks ..... 392/371

(List continued on next page.)

FOREIGN PATENT DOCUMENTS

BE 544029 1/1956
BE 553798 1/1957

(List continued on next page.)

OTHER PUBLICATIONS

Excerpt from Natl Research Council, "natl Building Code of Canada 1990", 10th ed., Ottawa, Cananda, 1990, pp. 316–318.
Excerpt from Natl Research Council, "natl Building Code of Canada 1995", 11th Edition, Ottawa, Cananda, 1995, pp. 297–306.

(List continued on next page.)

*Primary Examiner*—John A. Jeffery
(74) *Attorney, Agent, or Firm*—Foley & Lardner

(57) ABSTRACT

A heating convection unit and a method of mounting the same, provided with an envelope having a front face, a rear face, a top, a bottom and peripheral side walls. The front face and the peripheral side walls define an inner enclosure. The unit is also provided with a medial shield having front face, a rear face, a top, a bottom and peripheral side walls. The medial shield is mounted within the inner enclosure defined by the envelope and spaced apart therefrom. The rear face and peripheral side walls of the medial shield and the front face and peripheral side walls of the envelope define a ventilation passage having top and bottom openings in communication with ambient air. The medial shield preferably has an intermediate opening communicating with the ventilation passage. The unit is also provided with a cover having a front face, a rear face, a top and a bottom. The cover is fixed over the medial shield. The cover has top and bottom openings in communication with the ambient air. The top and bottom openings of the cover communicate with the top and bottom openings of the ventilation passage. The rear face of the cover and the front face of the medial shield define a convection passage between the top and bottom openings of the cover. The unit also has a heating element located inside the convection passage for heating the ambient air. The heating element is located proximate to the bottom opening of the cover. The intermediate opening of the medial shield is located above of the heating element.

9 Claims, 7 Drawing Sheets

U.S. PATENT DOCUMENTS

| | | | | | |
|---|---|---|---|---|---|
| 1,652,438 | A | * | 12/1927 | Hicks | 392/371 |
| 1,719,181 | A | * | 7/1929 | Johnson | 392/371 |
| 2,363,294 | A | | 11/1944 | Carrier | 257/3 |
| 2,512,529 | A | * | 6/1950 | Kercher | 392/371 |
| 2,552,837 | A | * | 5/1951 | Blazer | 392/371 |
| 2,606,992 | A | * | 8/1952 | MacDonald | 392/371 |
| 2,663,244 | A | | 12/1953 | MacDowell | |
| 2,727,978 | A | * | 12/1955 | Beckett et al. | 392/371 |
| 3,693,705 | A | | 9/1972 | Stotz | 165/22 |
| 3,804,156 | A | | 4/1974 | McDonough | 165/27 |
| 4,168,797 | A | | 9/1979 | Luke | 236/11 |
| 4,392,048 | A | | 7/1983 | Carter | 219/367 |
| 4,688,626 | A | | 8/1987 | Tengesdal | 165/4 |
| 4,712,611 | A | | 12/1987 | Witzel | 165/122 |
| 5,047,786 | A | | 9/1991 | Levy | 392/370 |
| 5,348,077 | A | | 9/1994 | Hillman | 165/16 |
| 5,413,530 | A | | 5/1995 | Montaz | 454/262 |
| 5,564,980 | A | | 10/1996 | Becker | 454/252 |
| 5,787,717 | A | | 8/1998 | Bang | 62/89 |

FOREIGN PATENT DOCUMENTS

| | | | | |
|---|---|---|---|---|
| CA | 1263052 | | 10/1985 | |
| CA | 1289117 | | 6/1987 | |
| DE | 40 02 560 | | 8/1991 | |
| FR | 1326550 | | 4/1963 | |
| FR | 1494090 | | 7/1967 | |
| FR | 2 302 485 | | 10/1976 | |
| FR | 2 679 982 | | 2/1993 | |
| GB | 599956 | * | 3/1948 | 392/371 |
| GB | 754790 | | 8/1966 | |
| GB | 1038144 | | 8/1966 | |
| NO | 95748 | * | 3/1960 | 392/370 |
| RU | 569818 | | 2/1978 | |

OTHER PUBLICATIONS

Excerpt from ASHRAE, "Ventilation for Acceptable Indoor Air Quality", ASHRAE Standard 62–1989, Atlanta, Georgia, USA, 1989, pp. 7–15.

Excerpt from CMHC, "Ventilation and Air Quality Testing in Electrically Heated Housing", Ottawa, Canada 1994, pp. 13 and 23a.

* cited by examiner

WALL MOUNTED ELECTRIC CONVECTION HEATER

FIELD OF THE INVENTION

The present invention concerns a heating convection unit. More specifically, it concerns such a unit for diffusing air and heat that can be recessed into a wall.

DESCRIPTION OF THE PRIOR ART

Convection systems are well-known to heat a room. They include essentially an convection passage in which a heating element is located. The ambient air to be heated circulates inside the convector by a movement of convection from the bottom towards the top of the device. For example, reference may be made to U.S. Pat. No. 4,392,048 to CARTER; U.S. Pat. No. 5,047,786 to LEVY; and to French application Ser. Nos. 2,302,485 and 2,679,982. However, one of the problems related to the use of conventional convectors is that these can only be mounted on the surface of a wall which is not generally very aesthetic.

Also known are the fan forced convectors that can be recessed. However, these convectors are considered to be noisy.

Consequently, there exists a need to conceal convectors by building them into walls without, however, creating noise problems as in fan forced convectors.

SUMMARY OF THE INVENTION

The present invention concerns a heating convection unit which is more aesthetic, more powerful, and which is noiseless, providing a greater comfort and that can be advantageously recessed in a wall.

According to the present invention, there is provided a heating convection unit comprising:

an envelope having a front face, a rear face, a top, a bottom and peripheral side walls, the front face and the peripheral side walls defining a inner enclosure;

a medial shield having front face, a rear face, a top, a bottom and peripheral side walls, the medial shield being mounted within the inner enclosure defined by the envelope and spaced apart therefrom, the rear face and peripheral side walls of the medial shield and the front face and peripheral side walls of the envelope defining a ventilation passage having top and bottom openings in communication with ambient air;

a cover having a front face, a rear face, a top and a bottom, the cover being fixed over the medial shield, the cover having top and bottom openings in communication with the ambient air, the top and bottom openings of the cover communicating with the top and bottom openings of the ventilation passage, the rear face of the cover and the front face of the medial shield defining a convection passage between the top and bottom openings of the cover; and a heating element located inside the convection passage for heating the ambient air, the heating element being located proximate to the bottom opening of the cover.

According to another aspect of the invention, there is provided a method of mounting a heating convection unit on a wall, comprising the steps of:

mounting an envelope on the wall, the envelope having a front face, a rear face, a top, a bottom and peripheral side walls, the front face and the peripheral side walls defining a inner enclosure;

mounting a medial shield within the inner enclosure defined by the envelope and spaced apart therefrom, the medial shield having front face, a rear face, a top, a bottom and peripheral side walls, the rear face and peripheral side walls of the medial shield and the front face and peripheral side walls of the envelope defining a ventilation passage having top and bottom openings in communication with ambient air;

fixing a cover over the medial shield, the cover having a front face, a rear face, a top and a bottom, the cover having top and bottom openings in communication with the ambient air, the top and bottom openings of the cover communicating with the top and bottom openings of the ventilation passage, the rear face of the cover and the front face of the medial shield defining a convection passage between the top and bottom openings of the cover; and providing a heating element inside the convection passage for heating the ambient air, the heating element being located proximate to the bottom opening of the cover.

In a preferred embodiment of the invention, the medial shield has an intermediate opening communicating with the ventilation passage, permitting the unit of the present invention to permit the mixing of fresh air provided by a fresh air network with ambient air present in the convection passage.

BRIEF DESCRIPTION OF THE FIGURES

The present invention will be better understood when reading the following description of preferred embodiments made in reference to the appending drawings in which.

DESCRIPTION OF THE PREFERRED EMBODIMENTS OF THE INVENTION

The present invention concerns a heating convection unit for diffusing heat in a room. It is similar to conventional electric convectors, but is different therefrom in order to achieve superior characteristics than products presently on the market.

Figure 1:
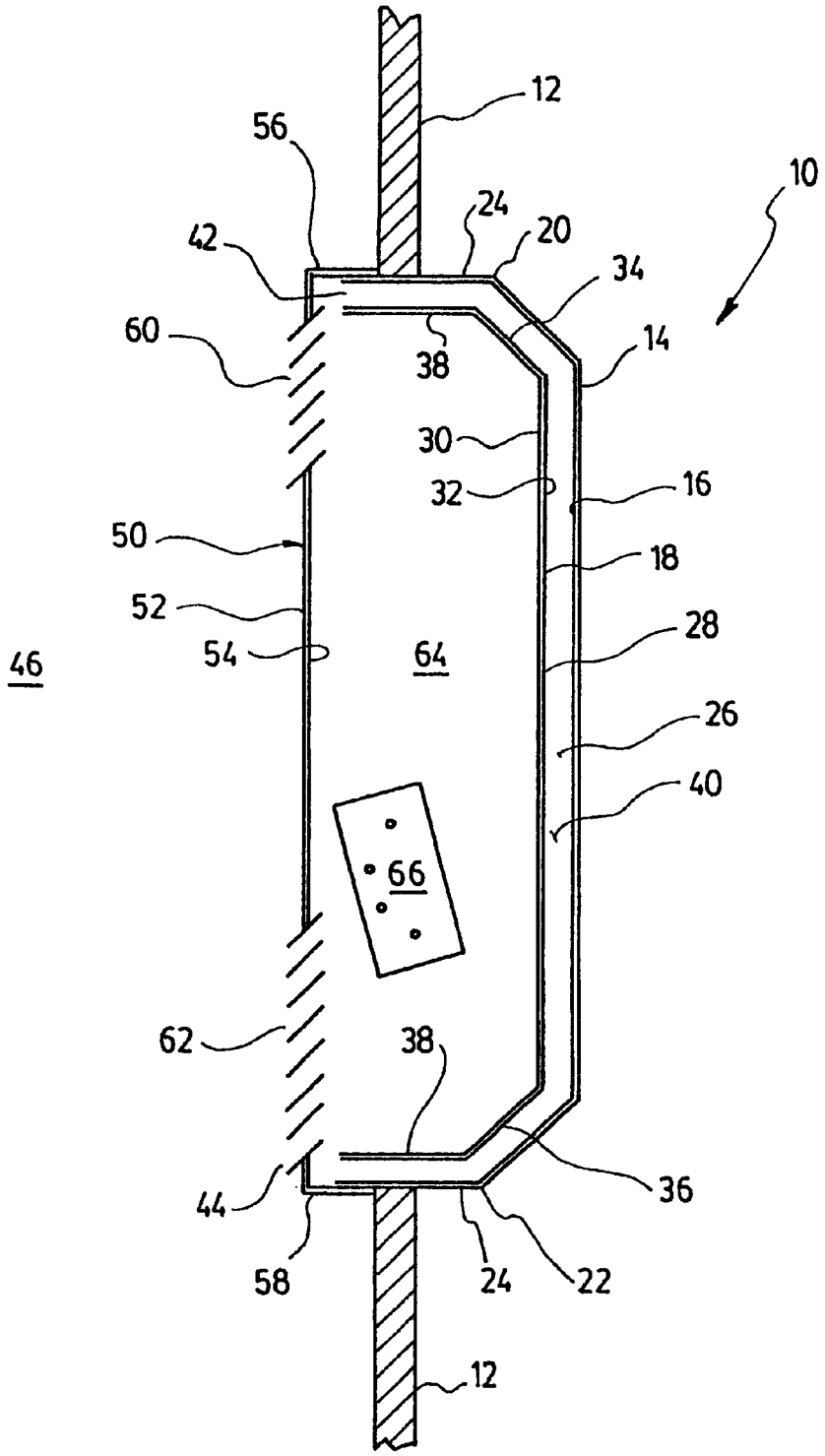
FIG. 1 is a schematic cross-sectional view of a heating convection unit according to a preferred embodiment of the present invention.

Referring to FIG. 1, a heating convection unit 10 is shown recessed in a wall 12. The unit 10 has an envelope 14 with a front face 16, a rear face 18, a top 20, a bottom 22 and peripheral side walls 24. The front face 16 and the peripheral side walls 24 of the envelope 14 define an inner enclosure 26. The envelope 14 may have a generally rectangular back plate with angled and orthogonal plates mounted thereon to form the side walls.

The unit 10 also has a medial shield 28 which is mounted within the inner enclosure 26 defined by the envelope 14. The medial shield 28 is mounted spaced apart from the envelope 14. The medial shield 28 has a front face 30, a rear face 32, a top 34, a bottom 36 and peripheral side walls 38 which generally conform with the corresponding shape of the envelope 14. The rear face 32 and peripheral side walls 38 of the medial shield 28 define a ventilation passage 40 which extends from the bottom to the top of the unit 10. The ventilation passage 40 has top and bottom openings 42, 44 in communication with the ambient air 46 of the room.

The unit 10 is provided with a cover 50 fixed over the medial shield 28. The cover 50 has a front face 52, a rear face 54, a top 56 and a bottom 58. The cover 50 has top and bottom openings 60, 62 in communication with the ambient air 46. The top and bottom openings 60, 62 may be formed by grids allowing the ambient air 46 to circulate in and out of the unit 10. The top and bottom openings 60, 62 of the cover 50 communicate with the corresponding top and bottom openings 42, 44 of the ventilation passage 40. The rear face 54 of the cover 50 and the front face 30 of the medial shield 28 define a convection passage 64 between the top and bottom openings 60, 62 of the cover 50.

The unit 10 is also provided with a heating element 66 located inside the convection passage 64 for heating the ambient air 46. The heating element 66 is located proximate of the bottom opening 62 of the cover 50, towards the bottom of the convection passage 64.The heating element 66 is preferably mounted on the front face 30 of the medial shield 28 and proximate to its bottom 36.

In operation, when the heating element 66 is turned on, the ambient air 46 enters through the bottom opening 62 of the cover 50 and is heated. This creates a circulation of air by convection which effectively displaces the heated air toward the top of the unit 10 through the convection passage 64 and out of the top opening 60 of the cover 50. The ambient air 46 which is colder than the heated air now enters through the bottom opening 62 of the cover 50 and the heated air continues to exit through the top opening 60. Part of the ambient air 46 also enters through the openings 42 and 44 of the ventilation passage 40 which maintains the envelope 14 at a lower temperature than the medial shield 28.

Figure 2:
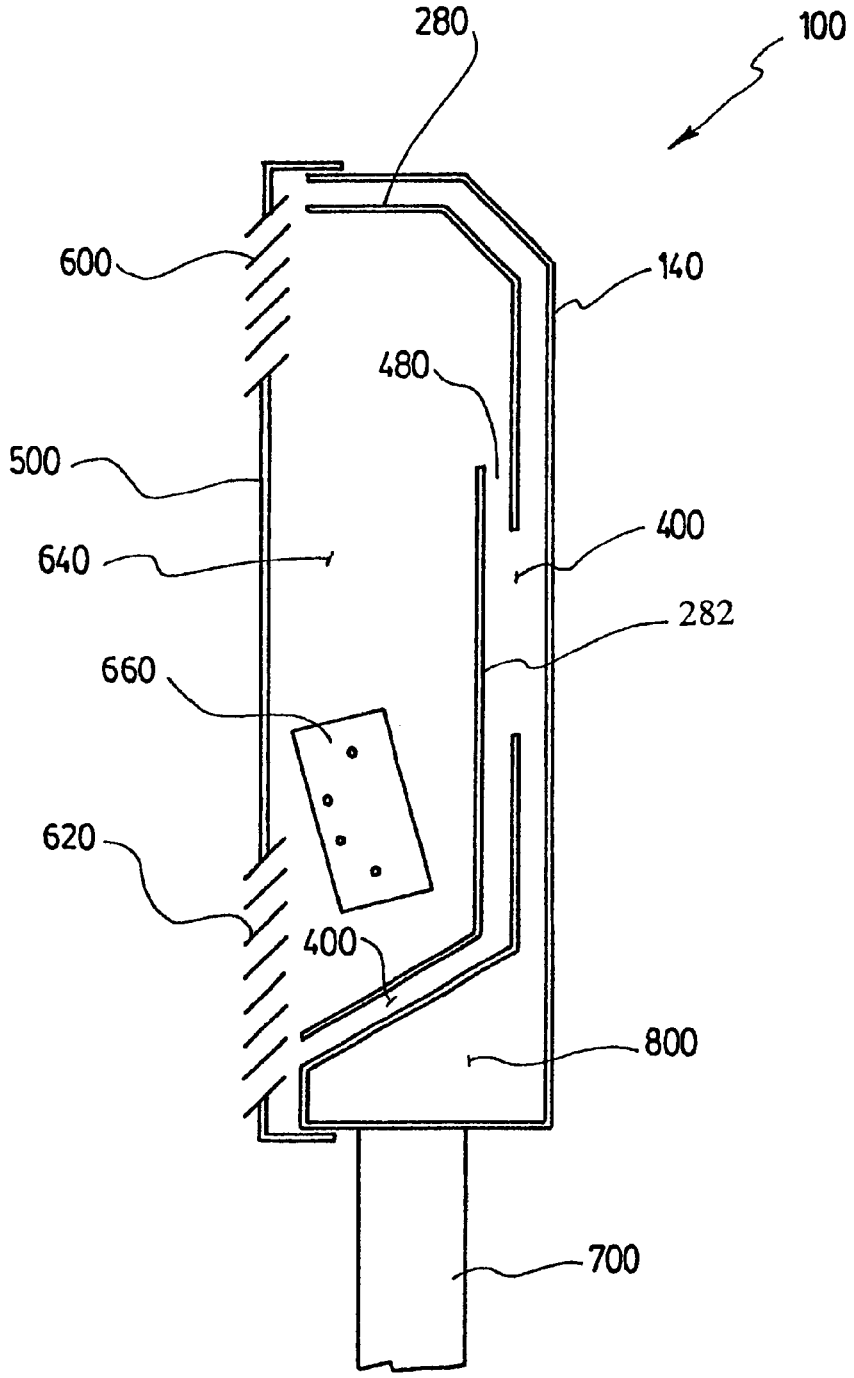
FIG. 2 is a schematic cross-sectional view of a heating convection unit according to another preferred embodiment of the present invention.

Referring to FIG. 2, there is shown a similar heating convection unit 100 as the one shown in FIG. 1. The unit 100 has an envelope 140 and a medial shield. However, the medial shield of this embodiment is made of two parts: a top medial shield 280 and a bottom medial shield 282, which define an intermediate opening 480. Alternatively, the top and bottom medial shields can be made of a single piece. An aspect of the intermediate opening is that it should be configured to prevent rising air to return to the ventilation passage 400. This is done, as in FIG. 2, by offsetting the top and bottom medial shields, but any other configuration is within the scope of the present invention.

A ventilation passage 400 is also defined between the envelope 140 and the medial shields 280, 282. A cover 500 is mounted over the medial shields 280, 282 and it defines a convection passage 640 with top and bottom openings or grids 600, 620. A heating element 660 is also provided in the convection passage 640.

Another difference from the unit shown in FIG. 1 is the presence of conduit 700 connected to an air chamber 800. The purpose of the conduit 700 is to push air mechanically into the air chamber 800 which is in communication with the ventilation passage 400.

In operation, the intermediate opening provides an added advantage over the embodiment of FIG. 1, as will be explained hereinafter. Some of the colder air inside of the ventilation passage 400 passes through the opening 480 of the medial shield 280 and is mixed with heated air in the convection passage 640. However, because of the convection that is created in the unit and the configuration of the shields, heated does not go in the ventilation passage 400, but rather exits through the top opening 600 of the cover 500.

Figure 3:
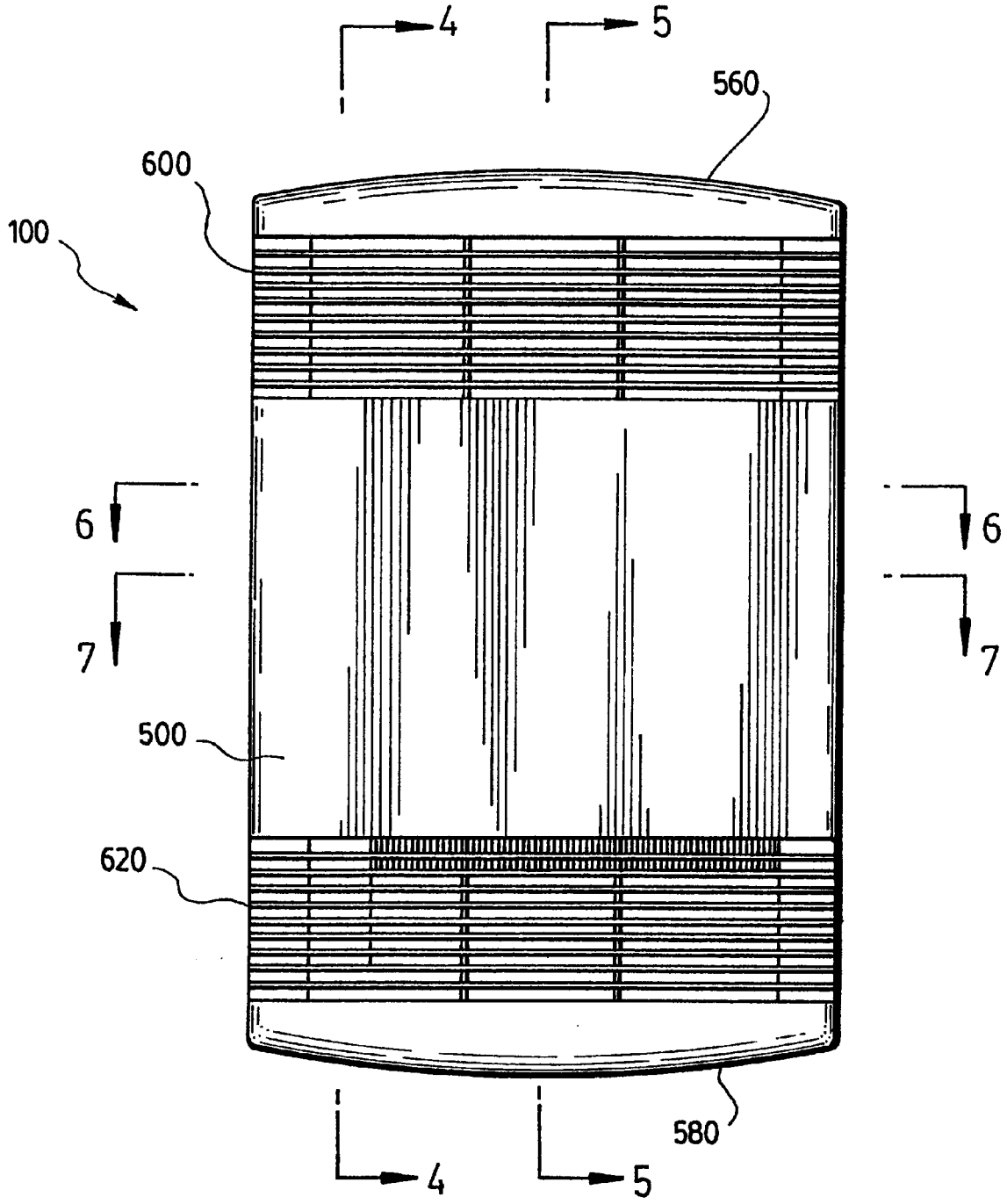
FIG. 3 is a front view of the unit of FIG. 2.
Figure 4:
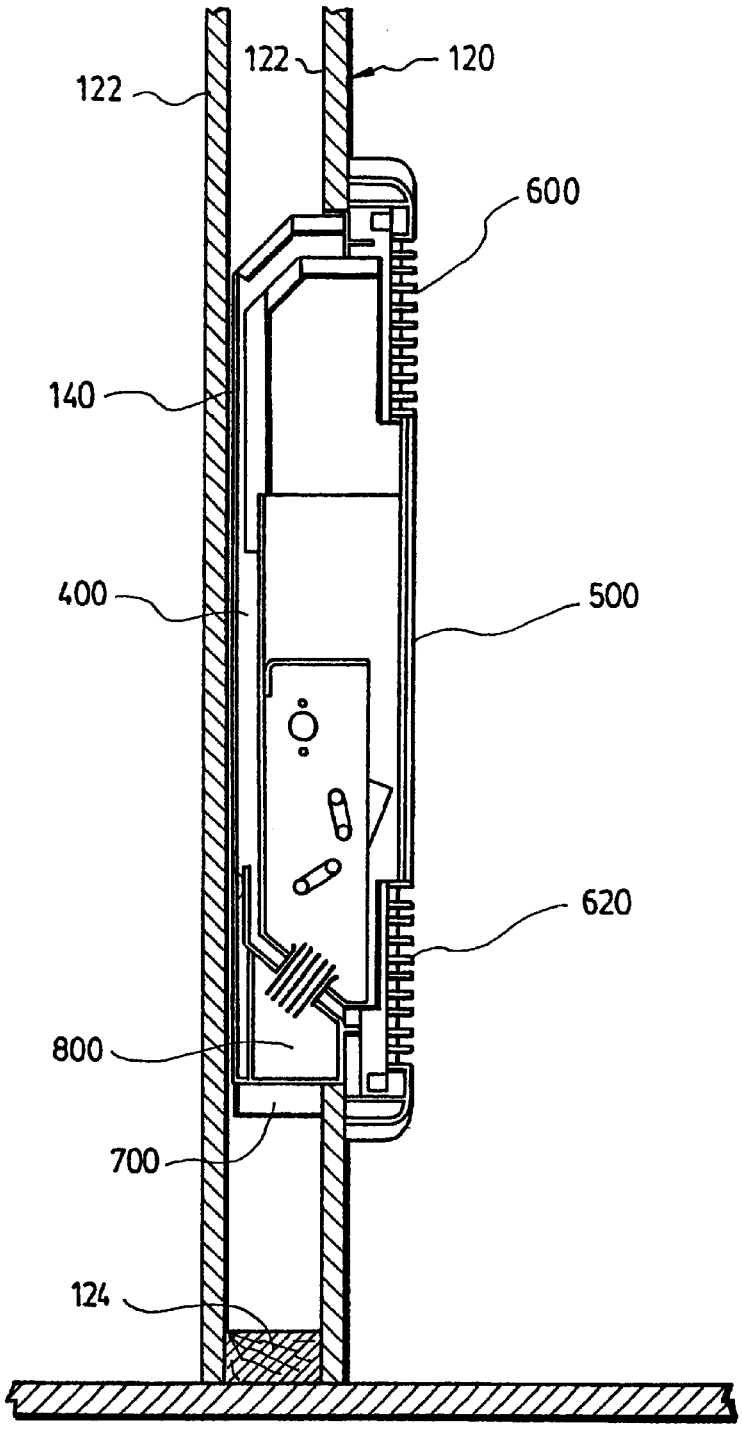
FIGS. 4 and 5 are side views of the unit of FIG. 3, taken along lines B—B and A—A respectively.
Figure 5:
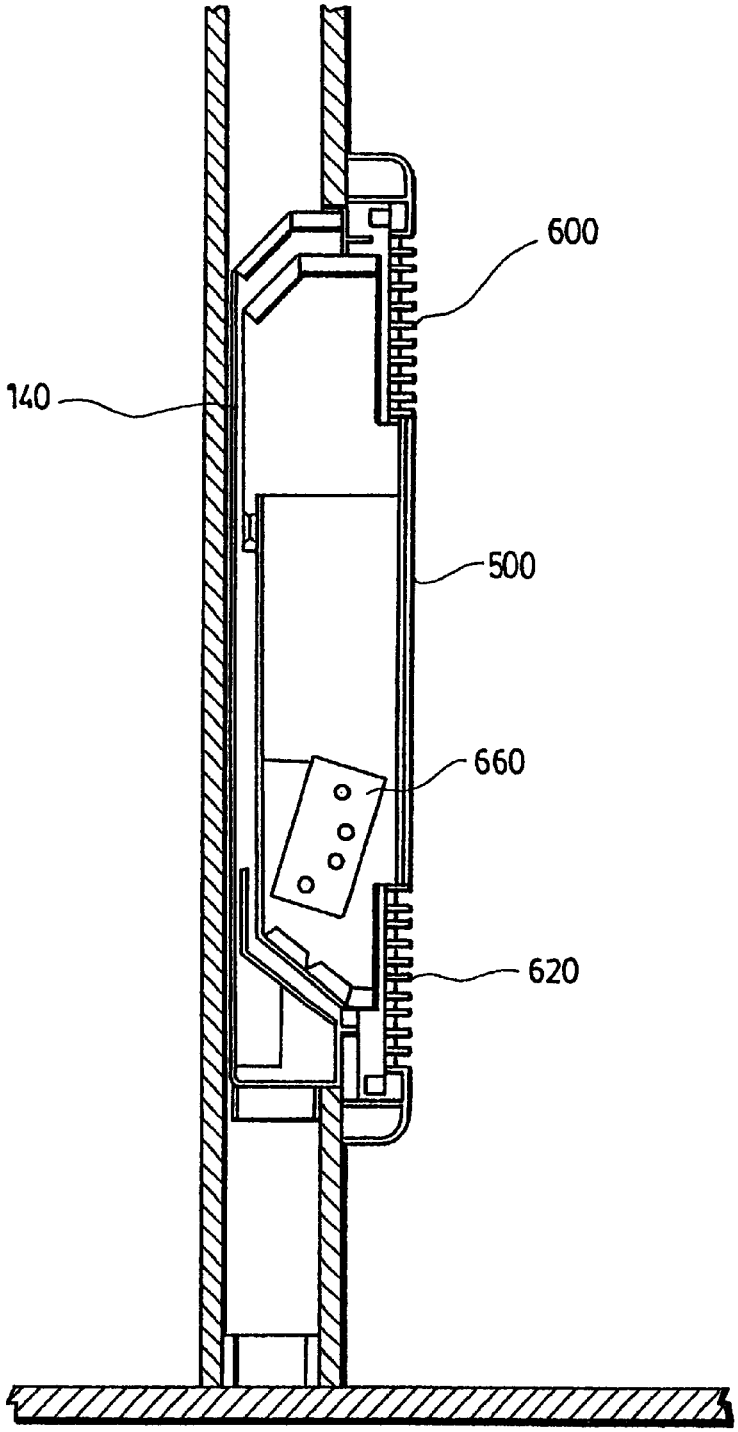

FIG. 3 shows a front elevation view of the unit 100 with the cover 500 and the top and bottom openings 600, 620 of the cover 500 with the top and bottom 560, 580 thereof.

FIGS. 4 to 7 shown the heating convection unit 100 recessed in a wall 120. The wall 120 may be made of gypsum boards 122 which are separated by conventional pieces of wood 124.

Figure 6:
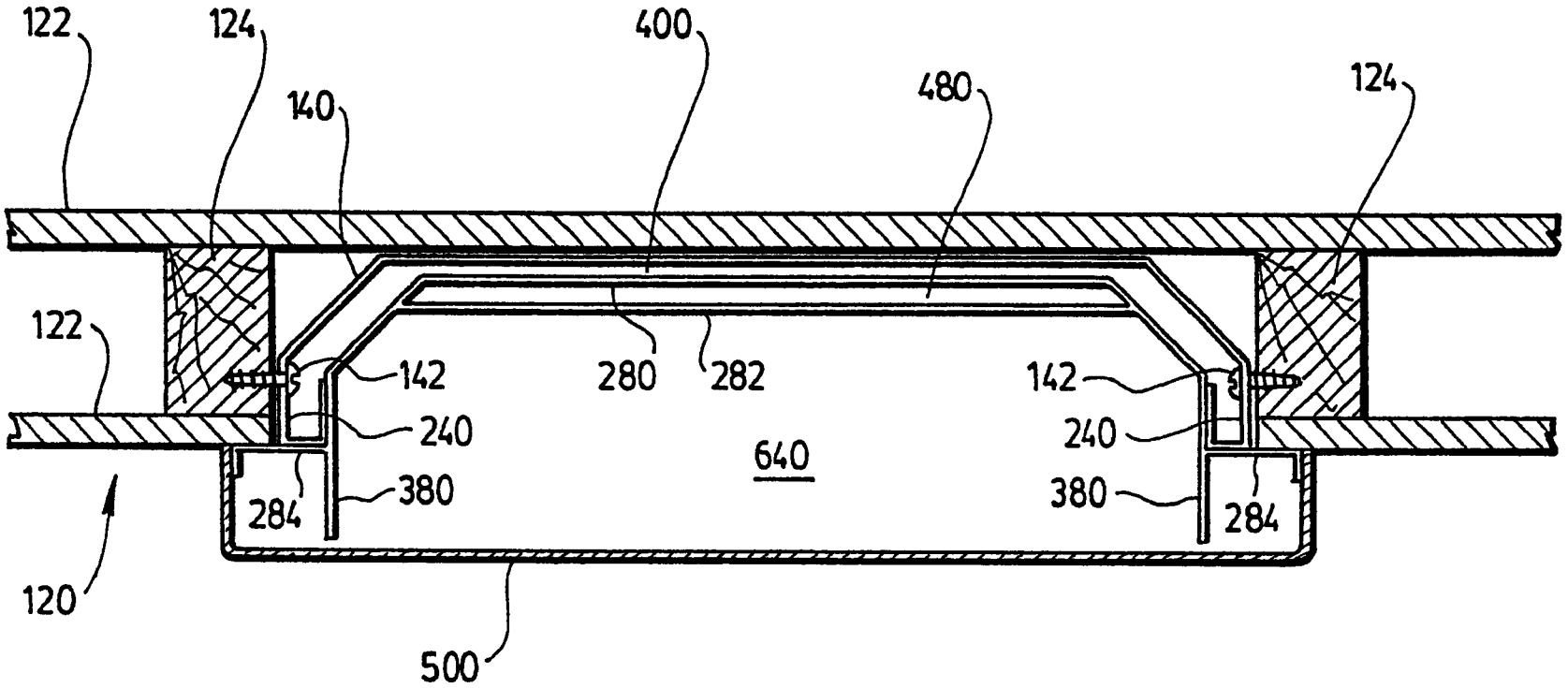
FIGS. 6 and 7 are cross-sectional views of the unit of FIG. 3, taken along lines D—D and E—E.
Figure 7:
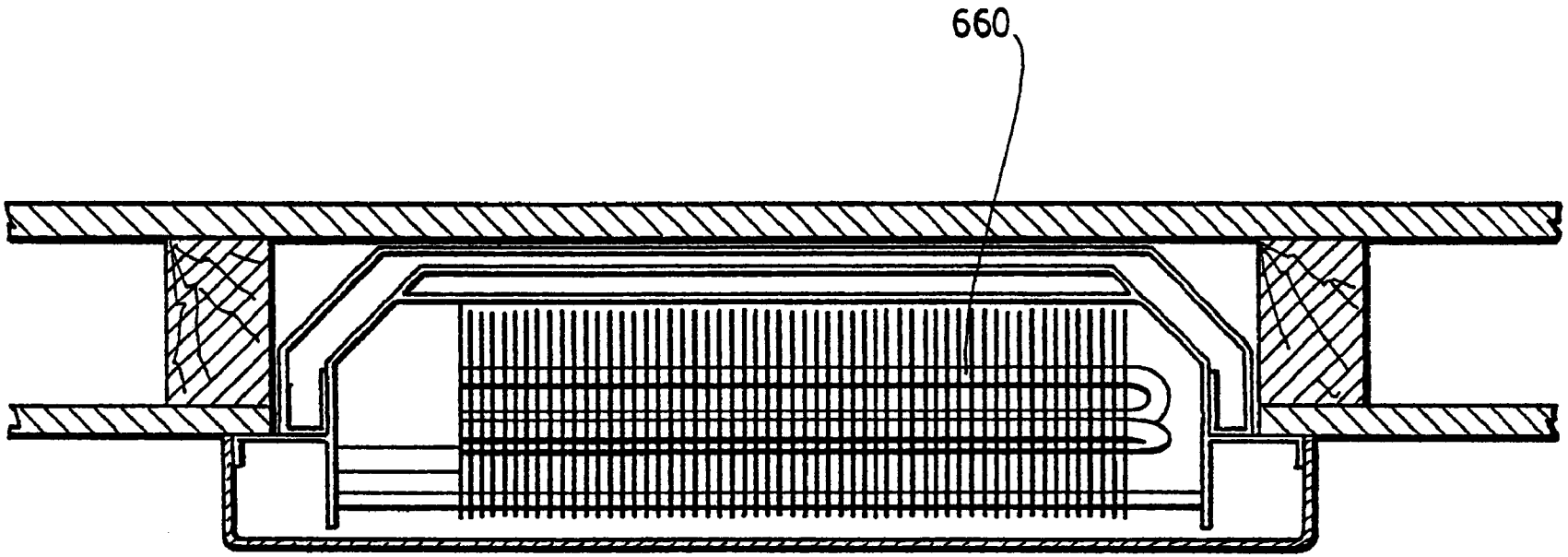

As best shown in FIG. 6, the envelope 140 has its peripheral sides 240 preferably fixed onto pieces of wood 124 that hold the wall 120. The envelope 140 may be fixed into the wall first with a set of screws 142. Thereafter, the medial shields 280, 282 may be mounted in a spaced apart relationship from the envelope 140 to form the ventilation passage 400. A pair of flanges 286 may be used to fix the medial shields 280, 282 to the wall 120. The medial shields 280, 282 are shown to have peripheral sides 380 extending all the way to the cover 500. These peripheral side walls 380 are provided in order to insulate the hot air from the portion of the device which is adjacent the wall, in order to maintain the temperature below to the prescribed limits.

When the unit 100 is connected to an air supply network leading to conduit 700, the air coming from this network is first diffused in a chamber 800 and then into the ventilation passage 400. A portion of the air is then mixed to the air in the unit 100 as it circulates into the convection passage via the intermediate opening 480. Another portion of the air circulates all around the ventilation passage 400. The air supplied by the network into the ventilation passage 400 keeps the envelope 140 at a temperature low enough to permit it to be in contact with combustible materials. However, as it was shown previously, the unit is designed such that even if there is no mechanical air supply, the natural convection created by the hot surface is sufficient to adequately ventilate the space and thus maintain the envelope at a reasonable temperature.

The arrangement as previously described permits, for dimensions similar to standard units of 750 and 1,000 W presently available on the market, to dissipate a thermal power of 1,500 W all the while respecting the prescribed temperature limits. Furthermore, due to the configuration of the unit according to a preferred embodiment of the invention, this unit can be recessed in a wall. Due to the optimization of the utilisation of natural convection, the unit can be used alone, without being connected to a conduit supplying fresh air, all the while conserving the same power characteristics.

The present invention permits the dissipation of a greater quantity of heat all the while maintaining the surface temperature so that it can be in contact with combustible material below the permitted limits (90° C.). It is thus possible to recess the unit in a wall, which is impossible with a conventional convector.

One of the principal characteristics of the present invention is the ventilation passage which is located between the medial shield and the envelope of the unit. This characteristic allows the device to work at full capacity even without a fresh air intake, the natural convection in the space permitting to cool the device sufficiently.

In a preferred embodiment of the invention, the unit is designed to be fed by a network of fresh air. However, the unit may function as well without the fresh air intake. These variants of the invention result in the same thermal characteristics on the unit.

The unit, according to the present invention, thus concerns a convector which is more aesthetic, more powerful and which is noiseless, providing a greater comfort and that can be advantageously recessed in a wall.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A heating convection unit that can be recessed comprising:

an envelope having a front face, a rear face, a top, a bottom and peripheral side walls, the front face and the peripheral side walls defining a inner enclosure;

a medial shield having front face, a rear face, a top, a bottom and peripheral side walls, the medial shield being mounted within the inner enclosure defined by the envelope and spaced apart therefrom, the rear face and peripheral side walls of the medial shield and the front face and peripheral side walls of the envelope defining a ventilation passage having top and bottom openings in communication with ambient air, the medial shield having an intermediate opening communicating with the ventilation passage;

a cover having a front face, a rear face, a top and a bottom, the cover being fixed over the medial shield, the cover having top and bottom openings in communication with the ambient air, the top and bottom openings of the cover communicating with the top and bottom openings of the ventilation passage, the rear face of the cover and the front face of the medial shield defining a convection passage between the top and bottom openings of the cover; and a heating element located inside the convection passage for heating the ambient air, the heating element being located proximate to the bottom opening of the cover, the intermediate opening of the medial shield being located above the heating element.

2. The unit according to claim 1, further comprising air intake means in communication with the ventilation passage.

3. The unit according to claim 2, wherein the air intake means comprises a conduit connected to an air supply network, the conduit being in communication with a chamber communicating with the ventilation passage.

4. The unit according to claim 1, wherein the medial shield has a bottom shield and a top shield defining the intermediate opening of the medial shield.

5. A method of mounting a heating convection unit on a wall, comprising the steps of:

mounting an envelope into the wall, the envelope having a front face, a rear face, a top, a bottom and peripheral side walls, the front face and the peripheral side walls defining a inner enclosure;

mounting a medial shield within the inner enclosure defined by the envelope and spaced apart therefrom, the medial shield having front face, a rear face, a top, a bottom and peripheral side walls, the rear face and peripheral side walls of the medial shield and the front face and peripheral side walls of the envelope defining a ventilation passage having top and bottom openings in communication with ambient air, the medial shield having an intermediate opening communicating with the ventilation passage;

fixing a cover over the medial shield, the cover having a front face, a rear face, a top and a bottom, the cover having top and bottom openings in communication with the ambient air, the top and bottom openings of the cover communicating with the top and bottom openings of the ventilation passage, the rear face of the cover and the front face of the medial shield defining a convection passage between the top and bottom openings of the cover; and providing a heating element inside the convection passage for heating the ambient air, the heating element being located proximate to the bottom opening of the cover, the intermediate opening of the medial shield being located above of the heating element.

6. A heating convection unit comprising:

an envelope having a front face, a rear face, a top, a bottom and peripheral side walls, the front face and the peripheral side walls defining an inner enclosure;

a medial shield having front face, a rear face, a top, a bottom and peripheral side walls, the medial shield being mounted within the inner enclosure defined by the envelope and spaced apart therefrom, the rear face and peripheral side walls of the medial shield and the front face and peripheral side walls of the envelope defining a ventilation passage having top and bottom openings in communication with ambient air;

a cover having a front face, a rear face, a top and a bottom, the cover being fixed over the medial shield, the cover having top and bottom openings in communication with the ambient air, the top and bottom openings of the cover communicating with the top and bottom openings of the ventilation passage, the rear face of the cover and the front face of the medial shield defining a convection passage between the top and bottom openings of the cover; and a heating element located inside the convection passage for heating the ambient air, the heating element being located proximate to the bottom opening of the cover, wherein said unit further comprises air intake means in communication with the ventilation passage, said air intake means comprising a conduit connected to an air supply network, the conduit being in communication with a chamber communicating with the ventilation passage.

7. The unit according to claim 6, wherein the medial shield is provided with an intermediate opening.

8. The unit according to claim 7, wherein the medial shield has a bottom shield and a top shield defining the intermediate opening of the medial shield.

9. A method of mounting a heating convection unit on a wall, comprising the steps of:

mounting an envelope into the wall, the envelope having a front face, a rear face, a top, a bottom and peripheral side walls, the front face and the peripheral side walls defining an inner enclosure;

mounting a medial shield within the inner enclosure defined by the envelope and spaced apart therefrom, the medial shield having a front face, a rear face, a top, a bottom and peripheral side walls, the rear face and peripheral side walls of the medial shield and the front face and peripheral side walls of the envelope defining a ventilation passage having top and bottom openings in communication with ambient air;

fixing a cover over the medial shield, the cover having a front face, a rear face, a top and a bottom, the cover having top and bottom openings in communication with the ambient air, the top and bottom openings of the cover communicating with the top and bottom openings of the ventilation passage, the rear face of the cover and the front face of the medial shield defining a convection passage between the top and bottom openings of the cover;

mounting air intake means in communication with the ventilation passage, said air intake means comprising a conduit connected to an air supply network, the conduit being in communication with a chamber communicating with the ventilation passage; and providing a heating element inside the convection passage for heating the ambient air, the heating element being located proximate to the bottom opening of the cover.

* * * * *